US007937801B2

(12) United States Patent
Egler et al.

(10) Patent No.: US 7,937,801 B2
(45) Date of Patent: May 10, 2011

(54) FLOOR CLEANING APPLIANCE

(75) Inventors: Christian Egler, Schwaikheim (DE); Roland Schick, Auenwald (DE); Brunhold Roppelt, Rudersberg (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/653,397

(22) Filed: Dec. 9, 2009

(65) Prior Publication Data

US 2010/0132150 A1 Jun. 3, 2010

Related U.S. Application Data

(63) Continuation of application No. PCT/EP2008/002866, filed on Apr. 11, 2008.

(30) Foreign Application Priority Data

Jun. 15, 2007 (DE) ..... 10 2007 029 258

(51) Int. Cl.
*A47L 11/30* (2006.01)

(52) U.S. Cl. ..... 15/320; 15/327.2; 15/327.6

(58) Field of Classification Search ..... 15/320, 15/327.2, 327.6; *A47I 11/30*
See application file for complete search history.

(56) References Cited

U.S. PATENT DOCUMENTS

| | | | |
|---|---|---|---|
| 5,615,448 | A | 4/1997 | Crouser et al. |
| 5,640,738 | A | 6/1997 | Williams et al. |
| 2002/0092116 | A1 | 7/2002 | Zahuranec et al. |
| 2003/0088939 | A1 | 5/2003 | Miner |
| 2005/0155175 | A1 | 7/2005 | Massaro |
| 2006/0000050 | A1 | 1/2006 | Cipolla et al. |
| 2006/0207052 | A1 | 9/2006 | Tran |

FOREIGN PATENT DOCUMENTS

| | | |
|---|---|---|
| DE | 10 2005 002 712 | 8/2005 |
| EP | 1 602 306 | 12/2005 |
| EP | 1 611 830 | 1/2006 |
| WO | 97/49324 | 12/1997 |

*Primary Examiner* — David A Redding
(74) *Attorney, Agent, or Firm* — Lipsitz & McAllister, LLC

(57) ABSTRACT

A floor cleaning appliance has a brush head in which a brush roller is rotatably mounted and which has at least one suction nozzle which is disposed next to the brush roller. Further, the floor cleaning appliance has a shank which is mounted on the brush head in a pivotable manner and on which a suction unit is disposed, as is a cleaning liquid container for cleaning liquid which can be applied to the floor surface to be cleaned, and a dirty liquid container for accommodating dirty liquid which is sucked up from the floor surface by means of the suction unit, the cleaning liquid container and the dirty liquid container together forming a container assembly which is adapted to be releasably connected to the shank. In order to develop the floor cleaning appliance in such a way that it is easier to handle, it is proposed that the cleaning liquid container is adapted to be releasably connected to the dirty liquid container.

23 Claims, 3 Drawing Sheets

FLOOR CLEANING APPLIANCE

This application is a continuation of international application number PCT/EP2008/002866 filed on Apr. 11, 2008.

The present disclosure relates to the subject matter disclosed in international application number PCT/EP2008/002866 of Apr. 11, 2008 and German application number 10 2007 029 258.0 of Jun. 15, 2007, which are incorporated herein by reference in their entirety and for all purposes.

BACKGROUND OF THE INVENTION

The invention relates to a floor cleaning appliance having a brush head in which a brush roller is rotatably mounted and which has at least one suction nozzle which is disposed next to the brush roller, and having a shank which is mounted on the brush head in a pivotable manner and on which a suction unit is disposed, as is a cleaning liquid container for cleaning liquid which can be applied to the floor surface to be cleaned, and a dirty liquid container for accommodating dirty liquid which is sucked up from the floor surface by means of the suction unit, the cleaning liquid container and the dirty liquid container together forming a container assembly which is adapted to be releasably connected to the shank.

Floor cleaning appliances of this type are known from US 2006/0000050 A1. Said floor cleaning appliances can be used to clean a floor surface by cleaning liquid being applied to the floor surface and this floor surface being brushed by means of the brush roller. The applied cleaning liquid can be transferred to the dirty liquid container, together with dirt which has been detached, under the suction action of the suction unit.

The two containers, like the suction unit, are mounted on the shank of the floor cleaning appliance. The shank is mounted on the brush head in a pivotable manner and usually carries a handle at its free end. The user can use the shank to guide the floor cleaning appliance along the floor surface to be cleaned.

US 2006/0000050 A1 proposes forming the cleaning liquid container and the dirty liquid container as a container assembly which can be handled jointly and can be releasably connected to the shank. The container assembly can be disconnected from the shank in order to fill the cleaning liquid container and to empty the dirty liquid container. However, combined filling and emptying of the container assembly is not necessary in every case. It is often necessary only to empty the dirty liquid container after use of the floor cleaning appliance, without also refilling the cleaning liquid container at the same time. Rather, refilling is in many cases first performed at the beginning of renewed use of the floor cleaning appliance, in which case it is then not necessary to empty the dirty liquid container. The design of the cleaning liquid container and the dirty liquid container in the form of a common container assembly therefore leads to more difficult handling of the floor cleaning appliance in some cases.

It is an object of the present invention to develop a floor cleaning appliance of this generic type in such a way that it is easier to handle.

SUMMARY OF THE INVENTION

According to the invention, this object is achieved in the case of a floor cleaning appliance of the type mentioned in the introduction in that the cleaning liquid container is adapted to be releasably connected to the dirty liquid container.

In the floor cleaning appliance according to the invention, the cleaning liquid container does indeed form a common assembly in combination with the dirty liquid container, and this common assembly is adapted to be disconnected as such from the shank of the floor cleaning appliance. However, in addition, the cleaning liquid container is adapted to also be disconnected from the dirty liquid container, that is to say the two containers can be separated from one another. This facilitates handling of the floor cleaning appliance. By way of example, the cleaning liquid container can be disconnected from the dirty liquid container at the beginning of a floor cleaning operation and then be filled with cleaning liquid in a simple manner. The full cleaning liquid container can then be reconnected to the dirty liquid container, so that the two containers form a common container assembly which is mounted on the shank of the floor cleaning appliance. If the dirty liquid container is full, the common container assembly can first be disconnected from the shank. The cleaning liquid container can then be removed from the dirty liquid container, so that the full dirty liquid container can then be taken to a disposal point for the dirty liquid and be emptied there. The empty dirty liquid container can then be reconnected to the cleaning liquid container and the common container assembly thus produced can then be fitted to the shank of the floor cleaning appliance.

The option of detaching the two containers from the shank as a common container assembly and then also disconnecting the two containers from one another facilitates handling of the floor cleaning appliance for the user.

It is particularly advantageous when the cleaning liquid container is adapted to be disconnected from the dirty liquid container while maintaining the connection between the dirty liquid container and the shank. A design of this kind allows the dirty liquid container to be left on the shank and nevertheless allows the cleaning liquid container to be removed from the shank. Specifically in an embodiment of this kind, the cleaning liquid container can be disconnected from the dirty liquid container without it being necessary to break the connection between the dirty liquid container and the shank for this purpose. As a result, the cleaning liquid container is filled in a particularly simple manner since the user only has to manipulate the cleaning liquid container, whereas the dirty liquid container can remain on the shank.

In an advantageous embodiment, the cleaning liquid container is disposed next to a side of the dirty liquid container. An arrangement of this kind has the advantage that the two containers are disposed virtually at the same level in relation to the floor surface to be cleaned. During operation of the floor cleaning appliance, the cleaning liquid container gradually empties and the dirty liquid container fills up at the same time. If the two containers are disposed one above the other, this causes a change in loading during operation, this loading being exerted on the user by the shank which is usually oriented obliquely during operation of the floor cleaning appliance. If the dirty liquid container is located above the cleaning liquid container, the loading which is to be borne by the user during operation of the floor cleaning appliance increases, since the weight of the dirty liquid container increases. However, if the two containers are disposed at virtually the same level, the user does not experience any significant change in loading. This improves the convenience of the floor cleaning appliance.

The cleaning liquid container is preferably disposed on the front face of the dirty liquid container since this facilitates accessibility to the cleaning liquid container for the user and therefore simplifies handling of the floor cleaning appliance.

Provision may be made, for example, for the dirty liquid container to have a recess accessible from a side into which the cleaning liquid container can be inserted. The recess is preferably located on the front face of the dirty liquid container.

It is particularly advantageous when the cleaning liquid container is adapted to be releasably latched to the dirty liquid container since, as a result, the cleaning liquid container can be disconnected from and reconnected to the dirty liquid container in a simple manner.

In order to keep the loading experienced by the user on account of the shank, which is usually oriented obliquely during operation of the floor cleaning appliance, and on account of the units mounted on said shank, particularly low, in a preferred embodiment of the invention, the suction device is formed as a bypass suction unit and is mounted on the shank below the container assembly, which comprises the cleaning liquid container and the dirty liquid container. On account of the suction unit being disposed below the container assembly, said suction unit is disposed only a short distance from the pivot axis of the shank. As a result, the loading exerted on the user by the shank during operation of the floor cleaning appliance can be kept low.

It is particularly advantageous when the axis of rotation of the suction unit is aligned coaxially with the pivot axis of the shank. In a configuration of this kind, the suction unit does not exert any torque on the shank when the shank is pivoted, but instead the suction unit is pivoted about its own axis of rotation, that is to say about the turbine axis which is usually aligned coaxially with the drive axis of the electric motor.

A separate brush motor can be used to rotate the brush roller which is rotatably mounted on the brush head. However, this leads to a structurally complicated and relatively large arrangement of the brush head. In an advantageous configuration, the brush roller is therefore coupled to the electric motor of the suction unit by means of a drive train. The electric motor of the suction unit drives a suction turbine and additionally also serves to drive the brush roller.

It is particularly advantageous here when the direction of rotation of the brush roller is identical to the direction of rotation of the electric motor. Therefore, the direction of rotation of the suction turbine is also identical to the direction of rotation of the brush roller. It has been found that the brush head can be formed to be particularly compact as a result, so that it has only a relatively small overall volume. In addition, the manufacturing and assembly costs of the brush head can be reduced by virtue of the suction unit and brush roller having a common direction of rotation.

In one preferred arrangement of the invention, a belt drive is used as the drive train by means of which the electric motor of the suction unit is coupled to the brush roller. On account of the common direction of rotation of the suction unit and brush roller, said belt drive does not have to cross over in order to reverse the direction of rotation. Therefore, the belt drive requires only a small installation space and its mechanical loading can be kept low.

It is advantageous when the drive train of the floor cleaning appliance is disposed on the left-hand side of the brush head, as viewed in the forward direction from the device. This has the advantage that the brush roller can extend directly to the right-hand edge of the brush head, and this in turn allows the brush roller to be positioned at a very short distance from a wall which bounds a floor surface when the floor surface is being cleaned, specifically in an ergonomically advantageous manner on the right-hand side of the brush head, as seen in the forward direction. The floor cleaning appliance therefore has the advantage that it has a very small edge distance on its right-hand side, that is to say the brush roller can be positioned very close to a wall on the right-hand side of the floor cleaning appliance.

It is particularly advantageous when the direction of rotation of the suction unit is counterclockwise as viewed in the direction toward the electric motor. The suction unit is preferably disposed in front of the electric motor as viewed in the axial direction. The drive shaft of the electric motor, and therefore also the suction unit and the brush roller, rotate in the counterclockwise direction as viewed in the direction toward the electric motor. Therefore, the direction of rotation of the brush roller corresponds to the direction of rotation of running wheels which are preferably used and are rotatably mounted on the brush head. The rotary movement of the brush roller therefore assists the forward movement of the floor cleaning appliance.

The following description of a preferred embodiment of the invention serves for more specific explanation in conjunction with the drawings.

DETAILED DESCRIPTION OF THE INVENTION

Figure 1:
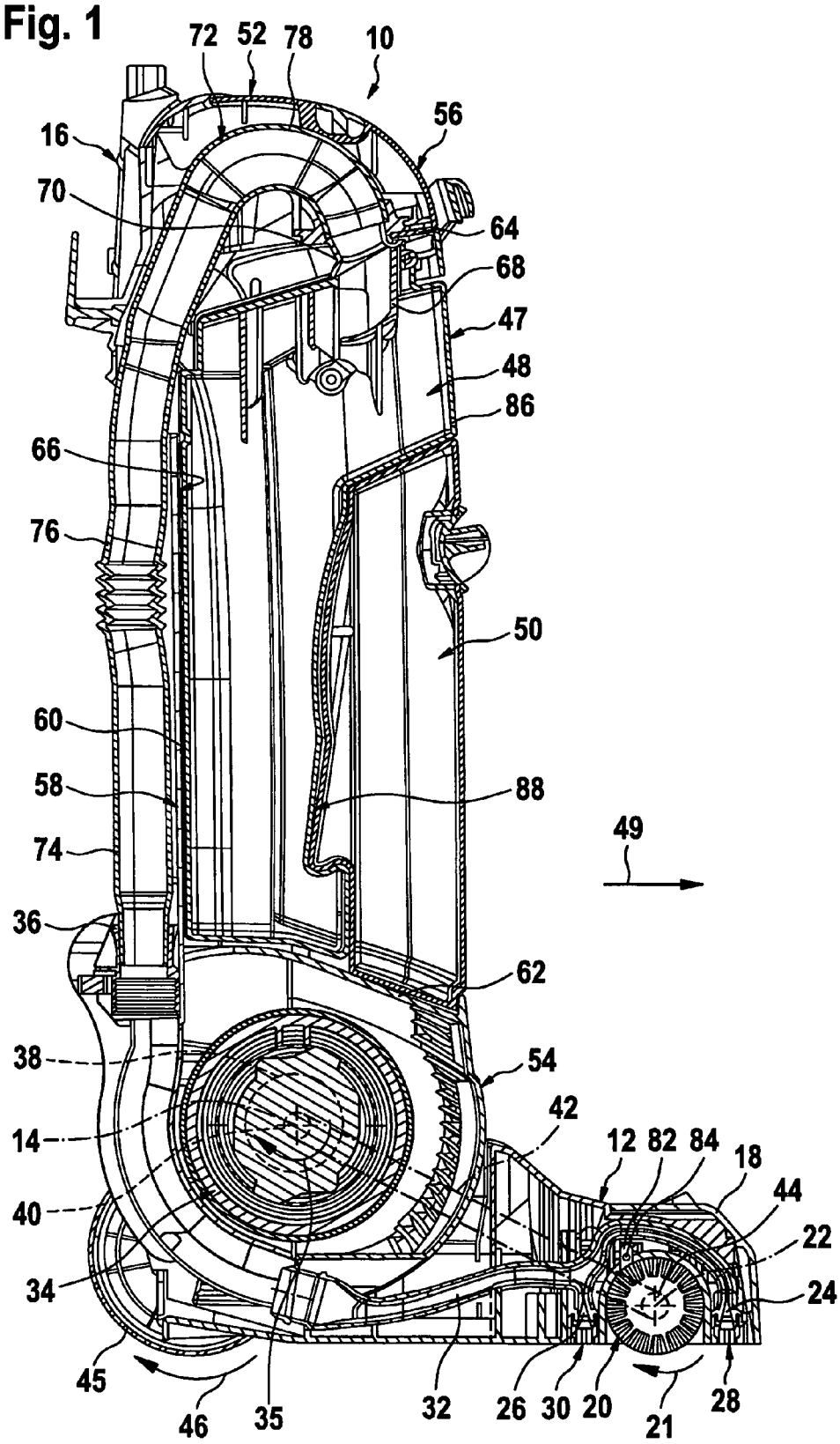
FIG. 1: shows a schematic partially sectioned view of a floor cleaning appliance according to the invention.
Figure 2:
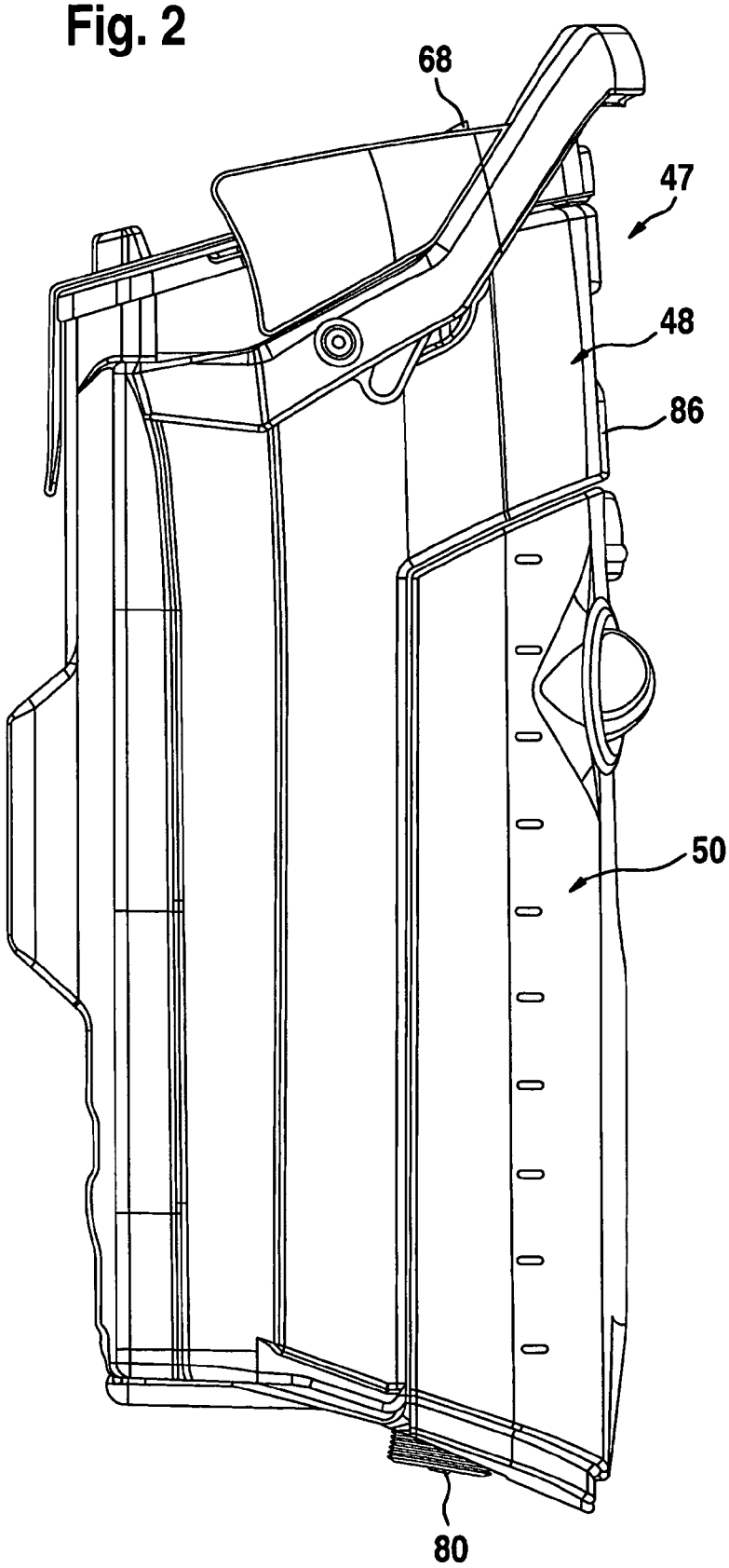
FIG. 2: shows a side view of a common container assembly of the floor cleaning appliance from FIG. 1, comprising a cleaning liquid container and a dirty liquid container.
Figure 3:
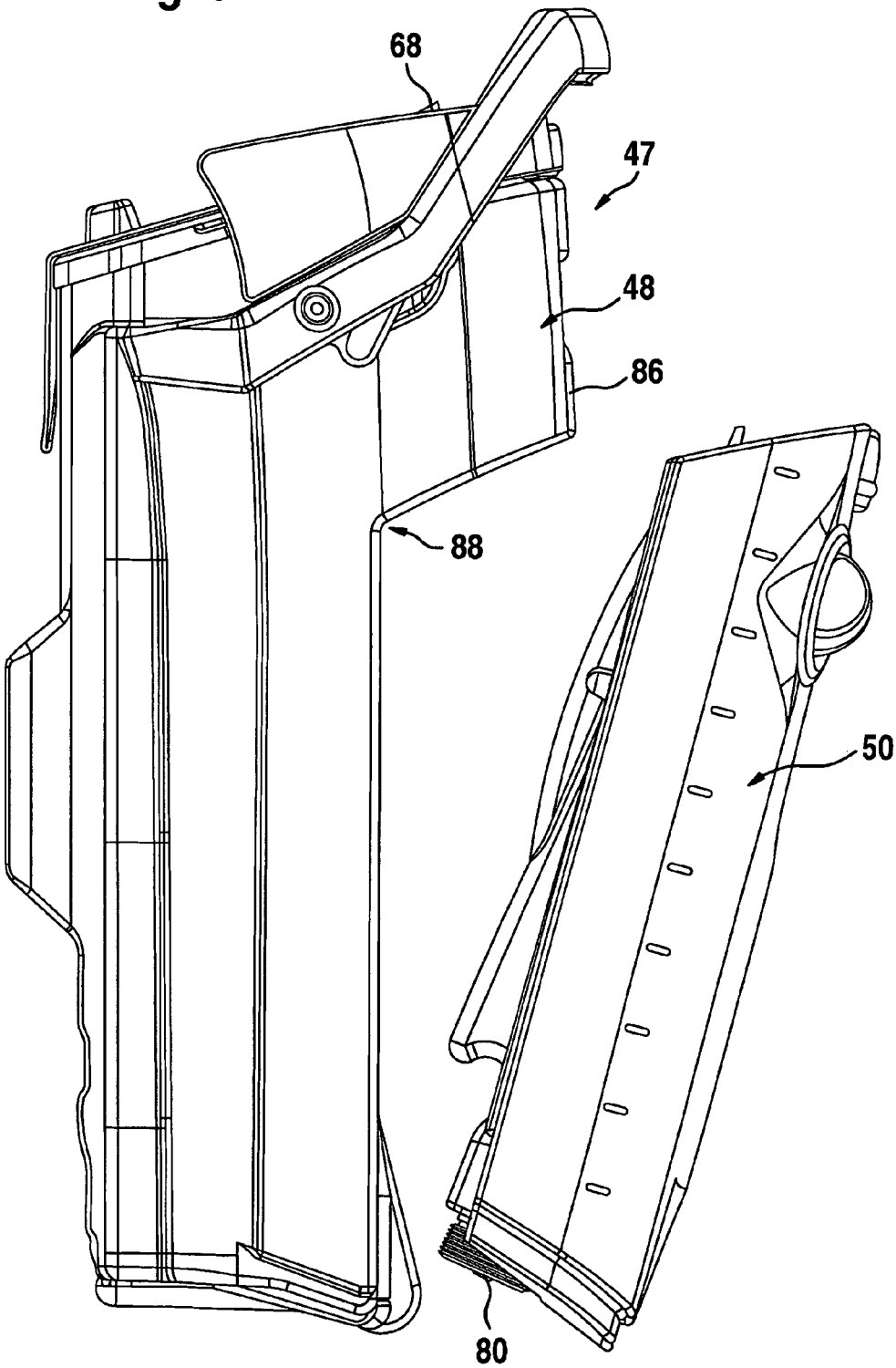
FIG. 3: shows a side view of the container assembly from FIG. 1, the cleaning liquid container being disconnected from the dirty liquid container.

FIG. 1 schematically illustrates a partially sectioned view of a floor cleaning appliance which is denoted overall by reference symbol 10. Said floor cleaning appliance comprises a brush head 12 on which a shank 16 is mounted such that it can pivot about a pivot axis 14. Said shank has a handle at its free end (not illustrated in the drawing) and the user can grasp the shank 16 in a simple manner at said handle.

The brush head 12 comprises a housing 18 in which a brush roller 20 is mounted such that it can rotate about an axis of rotation 22 which is aligned parallel to the pivot axis 14. In the continued movement direction of the floor cleaning appliance 10, the brush head 22 has a front and a rear suction nozzle 24, 26 in front of and behind the brush roller 20, the free ends of said suction nozzles each having a pair of suction lips disposed thereon, respectively 28 and 30. The two suction nozzles 24 and 26 are in flow connection with a suction line 32. The suction line 32 is operatively connected to a bypass suction unit 34 which can be used to apply a vacuum to the suction line 32. The suction line 32 has, at its free end which faces away from the suction nozzles 24, 26, a suction connection 36 which, like the suction unit 34, is mounted on the pivotable shank 16.

The direction 35 of rotation of the suction unit 34 is identical to the direction 21 of rotation of the brush roller 20. In order to be driven, the suction unit 34 has an electric motor 38, the drive shaft 40 of which is aligned coaxially with the pivot axis 14. The drive shaft 40 is in rotary connection with a belt pulley 44, which is mounted on the brush roller 20 in a rotationally fixed manner, by means of a belt drive 42, so that both the suction unit 34 and the brush roller 20 can be rotated in the same direction of rotation by the electric motor 38. The rotary movement is therefore transmitted from the electric motor 38 to the brush roller 20 by means of a drive train which does not have any elements which reverse the direction of rotation, for example gearwheels or the like.

As viewed in the axial direction, the suction unit 34 is disposed in front of the electric motor 38. As viewed in the direction toward the electric motor 38, the drive shaft 40 of said electric motor, and therefore also the suction unit 34 and the brush roller 20, rotate in the counterclockwise direction. Therefore, the direction of rotation 21 of the brush roller 20 corresponds to the direction of rotation 46 of the running wheels 45 which are mounted on the brush head 12, and the rotary movement of the brush roller 20 assists the forward movement 49 of the floor cleaning appliance 10.

The drive train, that is to say the belt drive 42, is disposed on the left-hand side of the brush head 12 in relation to the forward direction 49 and as seen from the floor cleaning appliance 10. The brush roller 20 extends directly to the right-hand edge of the brush head 12. This provides the option of positioning the brush roller 20 at a very short distance from a wall which bounds a floor surface when the floor surface is being cleaned, specifically in an ergonomically advantageous manner on the right-hand side of the brush head 12, as seen in the forward direction 49. The floor cleaning appliance 10 is therefore distinguished by a small edge distance on the right-hand side, that is to say the brush roller 20 can be positioned very close to a wall on the right-hand side of the brush head 12. This makes it considerably easier to handle the floor cleaning appliance 10.

A container assembly 47 is releasably mounted on the shank 16, said container assembly comprising a dirty liquid container 48 and a cleaning liquid container 50. The two containers 48 and 50 can be jointly disconnected from the shank 16. Said containers are connected to a shank housing 52 by means of a latching connection, said shank housing comprising a shank housing lower part 54, which accommodates the suction unit 34, and a shank housing upper part 56 which covers the container assembly 47. In addition, the shank housing 52 has a shank housing middle part 58 with a shank housing supporting wall 60 by means of which the shank housing upper part 56 is connected to the shank housing lower part 54. The shank housing supporting wall 60 defines, in combination with a top wall 62 of the shank housing lower part 54 and a base wall 64 of the shank housing upper part 56, an accommodation compartment 66 into which the container assembly 47 can be inserted and from which the container assembly 46 can also be removed as desired.

The dirty liquid container 48 has, on its upper face, a suction connection piece 68 which interacts in a sealing manner with a connecting piece 70 when the dirty liquid container 48 is inserted into the accommodation compartment 66. The connecting piece 70 is disposed at the free end of a connecting line 72 which has, at its end which faces away from the connecting piece 70, a tube piece 74 which is inserted into the suction connection 36. Starting from the suction connection 36, the connection line 72 runs along the rear face of the shank housing supporting wall 60 in a first line portion 76. An arcuate second line portion 78 connects with the first line portion 76 within the shank housing upper part 56.

The cleaning liquid container 50 has, on its underside, an outlet part 80 which interacts with a connection nipple (not illustrated in the drawing) that is disposed on the top wall 62 of the shank housing lower part 54. The connection nipple is in flow connection with a distributor pipe 82, which is disposed above the brush roller 20 and runs parallel to the axis 22 of rotation, by means of an outlet line (likewise not illustrated in the drawing in order to provide a better overview), said distributor pipe having a large number of outlet openings 84 which are disposed at a uniform distance from one another. Delivery of the cleaning liquid from the cleaning liquid container 50, via the outlet line, to the distributor pipe 82 is effected by means of a liquid pump (likewise not illustrated in the drawing in order to provide a better overview).

The cleaning liquid container can be filled with a cleaning liquid, preferably with water, which may have cleaning chemicals admixed with it if desired. The cleaning liquid can flow, starting from the cleaning liquid container 50, to the distributor pipe 82 and exit via the outlet openings 84, so that it can be applied, by the brush roller 20, to the floor surface to be cleaned. The floor surface can be treated by means of the wetted brush roller 20, and the applied liquid can be transferred to the dirty liquid container 48, together with dirt which has been detached, by means of the two suction nozzles 24, 26, the suction line 32 which connects with said suction nozzles, and the connection line 72. The suction flow required for this purpose is produced by the bypass suction unit 34.

The cleaning liquid container 50 is disposed on the front face 86 of the dirty liquid container 48 and can be disconnected from said dirty liquid container not only when it has been removed from the accommodation compartment 66, but the cleaning liquid container 50 can also be disconnected from the dirty liquid container 48 when said dirty liquid container is fixed in the accommodation compartment 66. To this end, the dirty liquid container 48 has, on its front face 86, a recess 88 into which the cleaning liquid container 50 can be inserted, it being possible for said cleaning liquid container to be releasably latched to the dirty liquid container 48.

If the cleaning liquid container 50 is to be filled, it is only necessary to release said cleaning liquid container from the dirty liquid container 48. The full cleaning liquid container 50 can then be reinserted into the recess 88, a flow connection being produced between the outlet part 80 and the corresponding connection nipple at the same time.

If the dirty liquid container 48 is to be emptied, it can be removed from the accommodation compartment 66 together with the cleaning liquid container 50. The cleaning liquid container 50 can then be removed from the dirty liquid container 48 and said dirty liquid container can be emptied in a simple manner. The two containers can then be reconnected to one another and inserted into the accommodation compartment 66 in the form of a common container assembly 47.

The invention claimed is:

1. Floor cleaning appliance comprising:

a brush head, a brush roller rotatably mounted in the brush head, at least one suction nozzle disposed in the brush head next to the brush roller, a shank mounted on the brush head in a pivotable manner, a suction unit disposed on the shank, a cleaning liquid container disposed on the shank for cleaning liquid which can be applied to a floor surface to be cleaned, and a dirty liquid container disposed on the shank for accommodating dirty liquid which is sucked up from the floor surface by means of the suction unit, the cleaning liquid container and the dirty liquid container together forming a container assembly which is adapted to be releasably connected to the shank, wherein:

the cleaning liquid container is adapted to be releasably connected to the dirty liquid container, and the dirty liquid container has a laterally accessible recess and the cleaning liquid container is adapted to be inserted into the recess.

2. Floor cleaning appliance according to claim 1, wherein the cleaning liquid container is adapted to be disconnected from the dirty liquid container while maintaining the connection between the dirty liquid container and the shank.

3. Floor cleaning appliance according to claim 1, wherein the cleaning liquid container is disposed laterally next to the dirty liquid container.

4. Floor cleaning appliance according to claim 3, wherein the cleaning liquid container is disposed on a front of the dirty liquid container.

5. Floor cleaning appliance comprising:

a brush head, a brush roller rotatably mounted in the brush head, at least one suction nozzle disposed in the brush head next to the brush roller, a shank mounted on the brush head in a pivotable manner, a suction unit disposed on the shank, a cleaning liquid container disposed on the shank for cleaning liquid which can be applied to a floor surface to be cleaned, and a dirty liquid container disposed on the shank for accommodating dirty liquid which is sucked up from the floor surface by means of the suction unit, the cleaning liquid container and the dirty liquid container together forming a container assembly which is adapted to be releasably connected to the shank, wherein:

the cleaning liquid container is adapted to be releasably connected to the dirty liquid container, and the cleaning liquid container is adapted to be latched to the dirty liquid container.

6. Floor cleaning appliance according to claim 5, wherein the dirty liquid container has a laterally accessible recess and the cleaning liquid container is adapted to be inserted into the recess.

7. Floor cleaning appliance comprising:

a brush head, a brush roller rotatably mounted in the brush head, at least one suction nozzle disposed in the brush head next to the brush roller, a shank mounted on the brush head in a pivotable manner, a suction unit disposed on the shank, a cleaning liquid container disposed on the shank for cleaning liquid which can be applied to a floor surface to be cleaned, and a dirty liquid container disposed on the shank for accommodating dirty liquid which is sucked up from the floor surface by means of the suction unit, the cleaning liquid container and the dirty liquid container together forming a container assembly which is adapted to be releasably connected to the shank, wherein:

the cleaning liquid container is adapted to be releasably connected to the dirty liquid container, and the suction unit is formed as a bypass suction unit and is mounted on the shank below the container assembly.

8. Floor cleaning appliance according to claim 7, wherein an axis of rotation of the suction unit is aligned coaxially with a pivot axis of the shank.

9. Floor cleaning appliance according to claim 7, wherein the brush roller is coupled to an electric motor of the suction unit by means of a drive train, a direction of rotation of the brush roller being identical to a direction of rotation of the electric motor.

10. Floor cleaning appliance according to claim 9, wherein the brush roller is coupled to the electric motor by means of a belt drive.

11. Floor cleaning appliance according to claim 9, wherein the drive train is disposed on a left-hand side of the brush head, as viewed from an operational position of the floor cleaning appliance.

12. Floor cleaning appliance according to claim 9, wherein a direction of rotation of the suction unit is identical to the direction of rotation of the electric motor and the direction of rotation of the brush roller.

13. Floor cleaning appliance according to claim 1, wherein the cleaning liquid container is adapted to be latched to the dirty liquid container.

14. Floor cleaning appliance according to claim 1, wherein the suction unit is formed as a bypass suction unit and is mounted on the shank below the container assembly.

15. Floor cleaning appliance according to claim 5, wherein the cleaning liquid container is adapted to be disconnected from the dirty liquid container while maintaining the connection between the dirty liquid container and the shank.

16. Floor cleaning appliance according to claim 5, wherein the cleaning liquid container is disposed laterally next to the dirty liquid container.

17. Floor cleaning appliance according to claim 16, wherein the cleaning liquid container is disposed on a front of the dirty liquid container.

18. Floor cleaning appliance according to claim 5, wherein the suction unit is formed as a bypass suction unit and is mounted on the shank below the container assembly.

19. Floor cleaning appliance according to claim 7, wherein the cleaning liquid container is adapted to be disconnected from the dirty liquid container while maintaining the connection between the dirty liquid container and the shank.

20. Floor cleaning appliance according to claim 7, wherein the cleaning liquid container is disposed laterally next to the dirty liquid container.

21. Floor cleaning appliance according to claim 20, wherein the cleaning liquid container is disposed on a front of the dirty liquid container.

22. Floor cleaning appliance according to claim 7, wherein the dirty liquid container has a laterally accessible recess and the cleaning liquid container is adapted to be inserted into the recess.

23. Floor cleaning appliance according to claim 7, wherein the cleaning liquid container is adapted to be latched to the dirty liquid container.

* * * * *